US010642202B2

(12) United States Patent
Kamoda et al.

(10) Patent No.: US 10,642,202 B2
(45) Date of Patent: May 5, 2020

(54) IMAGE FORMING APPARATUS

(71) Applicant: Konica Minolta Inc., Tokyo (JP)

(72) Inventors: Yuji Kamoda, Ibaraki (JP); Shota Sakurai, Machida (JP); Hiroyuki Saito, Itabashi (JP); Tatsuya Furuta, Mitaka (JP)

(73) Assignee: Konica Minolta Inc., Tokyo (JP)

( * ) Notice: Subject to any disclaimer, the term of this patent is extended or adjusted under 35 U.S.C. 154(b) by 0 days.

(21) Appl. No.: 16/534,325

(22) Filed: Aug. 7, 2019

(65) Prior Publication Data

US 2020/0073297 A1 Mar. 5, 2020

(30) Foreign Application Priority Data

Aug. 31, 2018 (JP) ..... 2018-162994

(51) Int. Cl.

| | |
|---|---|
| ***G03G 21/00*** | (2006.01) |
| ***G03G 15/20*** | (2006.01) |
| ***G03G 15/08*** | (2006.01) |
| ***G03G 15/02*** | (2006.01) |

(52) U.S. Cl.

CPC ..... *G03G 15/2025* (2013.01); *G03G 15/0225* (2013.01); *G03G 15/0812* (2013.01); *G03G 15/0848* (2013.01)

(58) Field of Classification Search

CPC ..... G03G 15/2025; G03G 15/0225; G03G 15/0848; G03G 15/0812

See application file for complete search history.

(56) References Cited

U.S. PATENT DOCUMENTS

| | | | | | |
|---|---|---|---|---|---|
| 5,915,156 | A * | 6/1999 | Kizaki | G03G 21/0029 | 399/346 |
| 2009/0185842 | A1* | 7/2009 | Hatori | G03G 21/0011 | 399/346 |
| 2010/0054829 | A1* | 3/2010 | Iio | G03G 21/0017 | 399/346 |

FOREIGN PATENT DOCUMENTS

| | | | | |
|---|---|---|---|---|
| JP | H09160455 | A | | 6/1997 |
| JP | 2004037479 | A | | 2/2004 |
| JP | 2007328094 | A | * | 12/2007 |
| JP | 2008008925 | A | * | 1/2008 |
| JP | 2008096600 | A | * | 4/2008 |
| JP | 2009157002 | A | * | 7/2009 |
| JP | 2010079019 | A | * | 4/2010 |
| JP | 2014238437 | A | * | 12/2014 |
| JP | 2015138076 | A | * | 7/2015 |

* cited by examiner

*Primary Examiner* — Susan S Lee

(74) *Attorney, Agent, or Firm* — Rankin, Hill & Clark LLP

(57) ABSTRACT

An image forming apparatus includes: an image carrier rotatably supported; a lubricant supplier that supplies lubricant to a surface of the image carrier; a blade that levels the lubricant supplied from the lubricant supplier in a film-like form on the surface of the image carrier; and a controller that controls image formation, wherein the controller has a lubricant removal mode to remove the lubricant accumulated on the blade, the lubricant removal mode includes a plurality of displacement modes each of which imparts different displacement to the blade, in each of the displacement modes, one of a displacement amount, a displacement speed, a displacement period, a displacement angle, and a displacement position of the blade is different, and the controller performs switching between the displacement modes dining execution of the lubricant removal mode.

10 Claims, 6 Drawing Sheets

FIG. 9
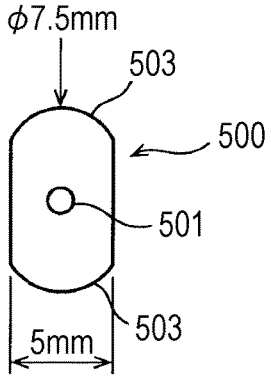
FIG. 10
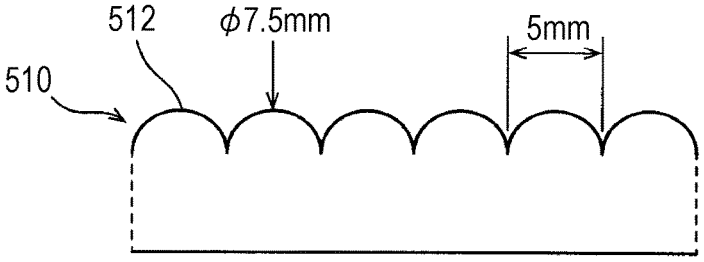
FIG. 11
| | IMAGE NOISE GENERATION RATE (%) | EVALUATION |
|---|---|---|
| COMPARATIVE EXAMPLE 1 | 12.5 | NG |
| COMPARATIVE EXAMPLE 2 | 5.1 | NG |
| FIRST EMBODIMENT | 0.7 | GOOD |
| COMPARATIVE EXAMPLE 3 | 7.5 | NG |
| SECOND EMBODIMENT | 2 | GOOD |
| COMPARATIVE EXAMPLE 4 | 4.8 | NG |
| THIRD EMBODIMENT | 1.2 | GOOD |
| COMPARATIVE EXAMPLE 5 | 7.9 | NG |
| FOURTH EMBODIMENT | 2.1 | GOOD |
| COMPARATIVE EXAMPLE 6 | 3.8 | NG |
| FIFTH EMBODIMENT | 0.3 | GOOD |

IMAGE FORMING APPARATUS

The entire disclosure of Japanese patent Application No. 2018-162994, filed on Aug. 31, 2018, is incorporated herein by reference in its entirely.

BACKGROUND

Technological Field

The present invention relates to an image forming apparatus.

Description of the Related Art

In an image forming apparatus using an electrophotographic process, a photoreceptor drum is electrically, charged by a charging device, and an electrostatic latent image is formed on the photoreceptor drum by emitting laser light based on image data. The electrostatic latent image is visualized by supplying a developer to the photoreceptor drum from a developing device, and an image is formed on the photoreceptor drum. The image formed on the photoreceptor drum is transferred to a sheet via a transfer belt and then fixed. Consequently, the image is formed on the sheet.

Additionally, the image forming apparatus includes a cleaning blade in order to remove afflicting matters such as residual toner afflicting to a surface of the photoreceptor drum. The cleaning blade is arranged in the vicinity of the photoreceptor drum such that a tip thereof abuts on the surface of the photoreceptor drum. Furthermore, the image forming apparatus also includes an application mechanism that applies lubricant to the photoreceptor drum in order to prevent the cleaning blade from turning up and improve removal performance. The application mechanism includes: a supply brush that supplies the lubricant to the photoreceptor drum; and a fixed blade that forms the supplied lubricant in a film-like form on the surface of the photoreceptor drum.

Note that JP H9-160455 A discloses, for example, a cleaning device for an electrophotographic image forming apparatus, in which remaining toner on an image carrier is removed and collected by a cleaning member that makes a tip of a cleaning blade abut on the image carrier. The cleaning device includes a vibration imparting member that collides with the cleaning member at a part excluding the tip of the cleaning blade and vibrates the cleaning blade.

For example, JP 2004-37479 A discloses a cleaning device that removes adhering matters on a photoreceptor drum. The cleaning device includes a cleaning blade that abuts on the photoreceptor drum; a vibrating member that vibrates the cleaning blade; a control circuit that controls operation of the vibrating member; and a fur brush that abuts on the photoreceptor drum. The vibrating member is operated while operation of the photoreceptor drum is stopped and while operation of the fur brush is stopped.

By the way, when lubricant supplied from a supply brush is accumulated on a fixed blade, a part of the accumulated lubricant may sneak through the fixed blade. In a region through which the lubricant has sneaked, there are problems that surface potential of a photoreceptor drum fluctuates and image noise (color streaks) is generated. For this reason, it is desirable to remove the lubricant accumulated on the fixed blade.

In this respect, in methods relating to clearing blades disclosed in JP H9-160455 A and JP 2004-37479 A, only displacement of a certain single pattern is imparted, to a cleaning blade. In other words, only certain external force is applied to the accumulated matters. For this reason, the accumulated matters that can be removed are limited, and the lubricant having high cohesion and high adhesion can be hardly removed, and an effective solution may not be provided.

SUMMARY

The present invention is made in view of the above-described situation and is directed to providing an image forming apparatus that can effectively remove the accumulated lubricant.

To achieve the abovementioned object, according to an aspect of the present invention, an image forming apparatus reflecting one aspect of the present invention comprises: an image carrier rotatable supported; a lubricant supplier that supplies lubricant to a surface of the image carrier; a blade that levels the lubricant supplied from the lubricant supplier in a film-like form on the surface of the image carrier; and a controller that controls image formation, wherein the controller has a lubricant removal mode to remove the lubricant accumulated on the blade, the lubricant removal mode includes a plurality of displacement modes each of which imparts different displacement to the blade, in each of the displacement modes, one of a displacement amount, a displacement speed, a displacement period, a displacement angle, and a displacement position of the blade is different, and the controller performs switching between the displacement modes during execution of the lubricant removal mode.

BRIEF DESCRIPTION OF THE DRAWINGS

The advantages and features provided, by one or more embodiments of the invention will become more fully understood from the detailed description given hereinbelow and the appended drawings Which are given by way of illustration only, and thus are not intended as a definition of the limits of the present invention:

FIG. 9 is an explanatory diagram illustrating a rotary member;

FIG. 10 is an explanatory diagram illustrating a swing member; and

FIG. 11 is an explanatory diagram illustrating an image noise generation rate in the first to fifth embodiments and Comparative Examples 1 to 6.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
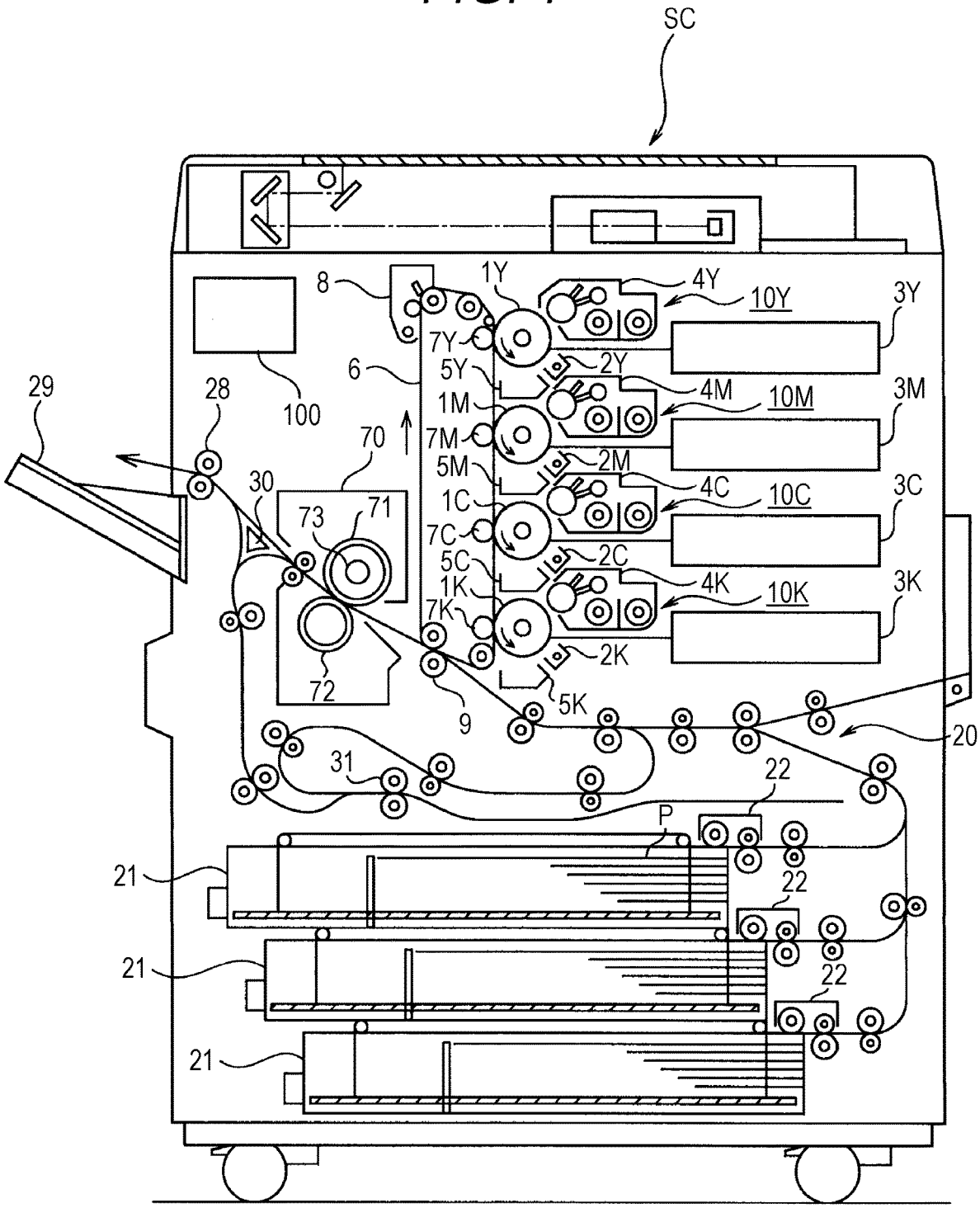
FIG. 1 is a structural diagram schematically illustrating au image forming apparatus.

FIG. 1 is a structural diagram schematically illustrating an image forming apparatus according to the present embodiment. This image forming apparatus is an image forming apparatus using an electrophotographic process, and is a so-called tandem-type full color image forming apparatus that forms a full-color image by vertically arraying a plurality of photoreceptor drums in a manner facing one intermediate transfer belt.

The image forming apparatus mainly includes a document scanner SC, image formers 10Y, 10M, 10C, and 10K, a fixing device 70, and a controller 100, in which these components are housed in one housing.

The document scanner SC scans and exposes a document image by an optical system of a scanning exposure device, and reads reflected light thereof by a line image sensor, thereby obtaining an image signal. The image signal is subjected to processing such as A/D conversion, shading correction, and compression, and then received in the controller 100 as image data. Note that the image data to be received in the controller 100 is not limited to the image data read by the document scanner SC and may be, for example, image data received from a personal computer connected to the image forming apparatus, image data received from another image forming apparatus, or image data stored in a portable recording medium such as a USB memory.

The image formers 10Y, 10M, 10C, and 10K respectively correspond to an image former 10Y that forms an image of yellow (Y), an image former 10M that forms an image of magenta (M), an image former 10C that forms an image of cyan (C), and an image former 10K that forms an image of black (K).

The image former 10Y includes a photoreceptor drum 1Y which is an image carrier that carries an image of a predetermined color (yellow (Y)), and also includes an electric Charger 2Y, an optical writer 3Y, a developing device 4Y, a cleaning device 5Y, and a primary transfer roller 7Y Which are arranged in a periphery of the photoreceptor drum.

The photoreceptor drum 1Y is rotatably supported, and a surface thereof is uniformly charged by the electric charger 2Y. A latent image is formed on the photoreceptor drum 1Y by scanning and exposing performed by the optical writer 3Y. The developing device 4Y develops the latent image on the photoreceptor drum 1Y by performing development with toner. Consequently, an image (toner image) corresponding to the yellow is formed on the photoreceptor drum 1Y. The image formed on the photoreceptor drum 1Y is sequentially transferred to a predetermined position on the intermediate transfer belt 6 by the primary transfer roller 7Y. The cleaning device 5Y removes the toner remaining on the photoreceptor drum 1Y.

Figure 2:
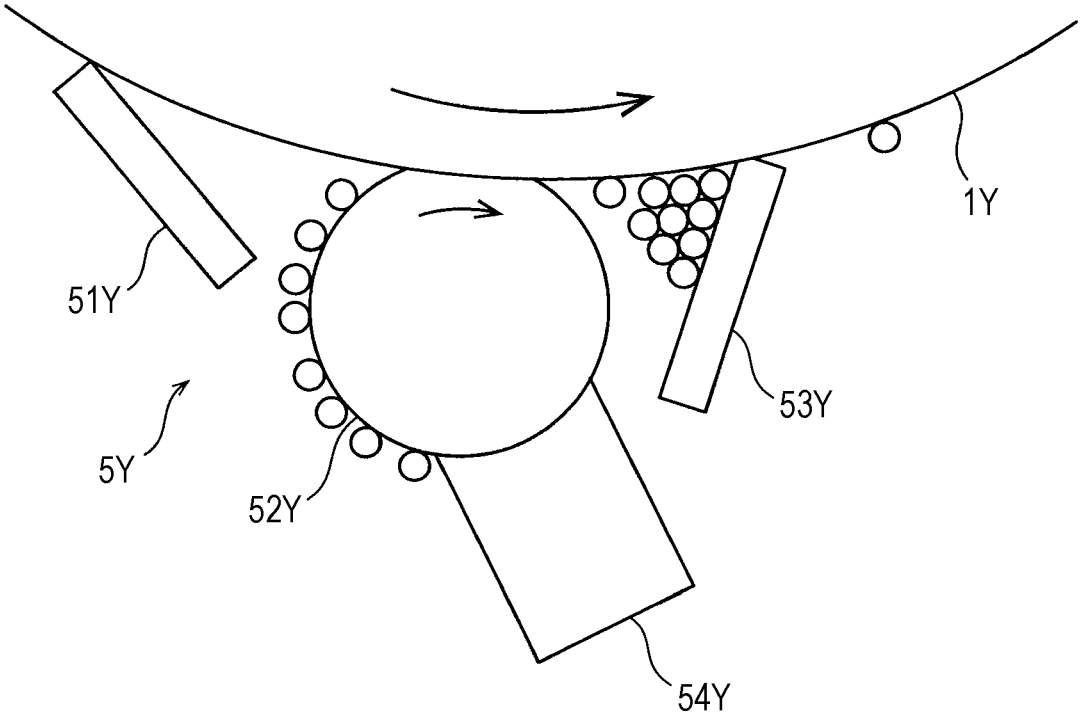
FIG. 2 is an explanatory diagram illustrating a detailed structure of a cleaning device.

FIG. 2 is an explanatory diagram illustrating a detailed structure of the cleaning device 5Y. The cleaning device 5Y includes a cleaning blade 51Y, an application brush 52Y, a fixed blade 53Y, and a lubricant supplier 54Y In this cleaning device 5Y, the cleaning blade 51Y, the application brush 52Y and the fixed blade 53Y are arrayed in this order from an upstream side to a downstream side in a rotational direction of the photoreceptor drum 1Y.

The cleaning blade 51Y scrapes off and removes the toner remaining on the photoreceptor drum 1Y. The cleaning blade 51Y is formed by, for example, processing polyurethane rubber into a predetermined shape, and a base end thereof is held by a holding sheet metal (not illustrated). The cleaning blade 51Y is arranged in a manner being pressed against the photoreceptor drum 1Y in a state in which a tip thereof is oriented in an opposite direction (counter direction) of the rotational direction of the photoreceptor drum 1Y.

The application brush 52Y supplies lubricant to a surface of the photoreceptor drum 1Y. The application brush 52Y is rotatably supported and arranged parallel to the photoreceptor drum 1Y. The application brush 52Y is pressure-fitted to the photoreceptor drum 1Y such that a tip of the application brush 52Y bites into the surface of the photoreceptor drum by a predetermined amount. Note that, as a method of applying the lubricant to the photoreceptor drum 1Y, a roller or the like can also be used instead of using the brush.

The fixed blade 53Y is a blade that levels, in a film-like form, the lubricant supplied to the photoreceptor drum 1Y on the surface of the photoreceptor drum 1Y. Similar to the cleaning blade 51Y, the fixed blade 53Y is formed by, for example, processing polyurethane rubber into a predetermined shape, and a base end thereof is held by a holding metal sheet plate (not illustrated). The fixed blade 53Y is arranged in a manner being pressed against the photoreceptor drum 1Y in a state where a tip thereof is oriented in a direction (trail direction) same as the rotational direction of the photoreceptor drum 1Y.

The lubricant supplier 54Y includes the lubricant and a pressing member such as a compression spring and supplies the lubricant to the application brush 52Y For example, the lubricant is obtained by melting and molding zinc stearate powder. The lubricant supplier 54Y is provided below the application brush 52Y. The lubricant is biased upward by the pressing member and pressed to the application brush 52Y.

In the cleaning device 5Y, the application brush 52Y is rotated at a linear velocity faster than that of the photoreceptor drum 1Y in the rotational direction in which a velocity vector at a nip is the same direction as a velocity vector of the photoreceptor drum 1Y The lubricant of the lubricant supplier 54Y is scraped off by the rotation of the application brush 52Y and adheres to the application brush 52Y When the lubricant that has adhered to the application brush 52Y is conveyed by the rotation of the application brush 52Y to the nip formed with the photoreceptor drum 1Y, the lubricant is supplied to the surface of the photoreceptor drum 1Y. The lubricant on the photoreceptor drum 1Y is conveyed to the fixed blade 53Y by the rotation of the photoreceptor drum 1Y, and a lubricant film is formed on the surface of the photoreceptor drum 1Y by pressing force of the fixed blade 53Y. Such a film of the lubricant can improve transferability and cleaning performance of the photoreceptor drum 1Y.

The other image formers 10M, 10C, and 10K have similar structures, respectively include the photoreceptor drums 1M, 1C, and 1K, and further respectively include electric chargers 2M, 2C, and 2K, optical writers 3M, 3C, and 3K, developing devices 4M, 4C, and 4K, cleaning devices 5M, 5C, and 5K, and primary transfer rollers 7M, 7C, and 7K which are arranged in peripheries of the respective photoreceptor drums.

A belt cleaner 8 cleans the surface of the intermediate transfer belt 6 having finished image transfer, and the cleaned intermediate transfer belt 6 is subjected to next image transfer. The belt cleaner 8 includes cleaning members such as a brush roller, a blade, and a metal roller.

An image formed in each color and transferred onto the intermediate transfer belt 6 is transferred by a secondary transfer roller 9 to a sheet P conveyed at predetermined timing by a sheet conveyor 20 described later. The secondary transfer roller 9 forms a nip (transfer nip) by being arranged in a manner pressure-contacting the intermediate transfer belt 6, and transfers the image onto the sheet P.

The sheet conveyor 20 conveys the sheet P along a Conveyance path. The sheet P is stored in a sheet feeding tray 21, and the sheet P stored in the sheet feeding tray 21 is taken in by a sheet feeder 22 and sent to the conveyance path. In the conveyance path, a plurality of conveyance members that conveys the sheet P is provided more on an upstream side than the transfer nip. Each of the conveyance members includes a pair of rollers that pressure-contact each other, and at least one roller thereof is rotationally driven via an electric motor that is a driving member. The conveyance members hold the sheet P and are rotated to convey the sheet P. Note that, as for the conveyance members, it is possible to adopt a structure in a wide range including a pair of rotary members, such as a combination of belts or a combination of a belt and a roller, besides the structure including the pair of rollers.

The fixing device 70 is a device that applies fixing processing to fix the image that has been transferred onto the sheet P. The fixing device 70 includes, for example, a fixing roller 71, a pressure-contact roller 72, and a fixing heater 73 that heats the fixing roller 71. The fixing roller 71 and the pressure-contact roller 72 form a nip (fixing nip) by being arranged in a manner pressure-contacting each other. The fixing device 70 fixes the image that has been transferred to the sheet P by: pressure-fixing by the fixing roller 71 and the pressure-contact roller 72; and heat-fixing by the fixing heater 73.

The sheet P subjected to the fixing processing by the fixing device 70 is ejected by a sheet ejection roller 28 to a sheet ejection tray 29 attached to an outer side surface of the housing. Additionally, in a case of forming an image also on a back surface of the sheet P, the sheet P having the image formed on one surface of the sheet is conveyed by a switching gate 30 to a reverse roller 31 located below. The reverse roller 31 holds a tail end of the conveyed sheet P, reverses the sheet P by performing reverse feeding, and sends the sheet P to a refeeding conveyance path. The sheet P sent to the refeeding conveyance path is conveyed by a plurality of conveyance members provided for sheet refeeding, and the sheet P is refed to the transfer position.

The controller 100 has a function to integrally control the image forming apparatus. As the controller 100, a microcomputer mainly including a CPU, a ROM, a RAM, and an I/O interface can be used. The controller 100 controls image formation by controlling the image formers 10Y, 10M, 10C, and 10K, the fixing device 70, and the like.

In the following, a structure and operation to remove the lubricant accumulated on the fixed blade 53Y will be described by exemplifying the cleaning device 5Y. Note that the description provided below is applied to the cleaning devices 5M, 5C, and 5Y in a similar manner.

Speaking of a relation with the present embodiment, the controller 100 has a lubricant removal mode in which the lubricant accumulated on the fixed blade 53Y is removed, while image forming operation is stopped. The lubricant removal mode has a plurality of displacement modes in each of which different displacement is imparted to the fixed blade 53Y. In this case, in each of the displacement modes, any one of a displacement amount, a displacement speed, a displacement period, a displacement angle, and a displacement position of the fixed blade 53Y is different, Additionally, the controller 100 sequentially performs switching between the displacement modes during execution of the lubricant removal mode.

First Embodiment

Figure 3:
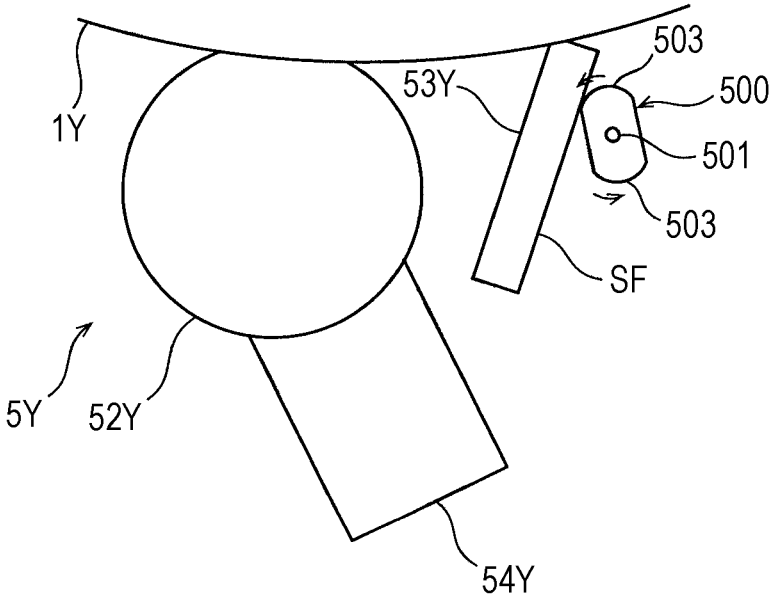
FIG. 3 is an explanatory diagram illustrating main components of a cleaning device according to a first embodiment.

FIG. 3 is an explanatory diagram illustrating main components of a cleaning device 5Y according to a first embodiment. In the first embodiment, the cleaning device 5Y includes a rotary member 500. The rotary member 500 is arranged in the vicinity of the fixed blade 53Y on a non-abutting surface SF side that is included in a fixed blade 53Y and does not abut on a photoreceptor drum 1Y.

A rotary shaft 501 extending along an axial direction of the photoreceptor drum 1Y is attached to the rotary member 500, and the rotary member 500 is rotated together with the rotary shaft 501. A power transmission mechanism such as a motor or a gear is connected to the rotary shaft 501, and a rotation speed or a rotational direction of the rotary member 500 is controlled by a controller 100.

In the rotary member 500, a cross-sectional shape of a two-dimensional plane which the rotary shaft 501 perpendicularly passes through is formed in a cam shape, specifically, an ellipse or an oval. The rotary member 500 can perform, by own rotation, switching between an abutting state and a non-abutting state relative to the fixed blade 53Y.

When the rotary shall 501 is rotated, the rotary member 500 is also rotated synchronously. When the rotary member 500 is rotated, both ends in a longitudinal direction (hereinafter referred to as "longitudinal ends") 503 of the rotary member 500 alternately abut on the non-abutting surface SF of the fixed blade 53Y. In other words, the abutting state in which one longitudinal end 503 abuts and the non-abutting state in which the one longitudinal ends 503 having abutted advances and the other longitudinal end 503 reaches are alternately repeated.

With the abutment of each of the longitudinal ends 503, external force acts on the fixed blade 53Y, thereby displacing the fixed blade 53Y. Due to such displacement of the fixed blade 53Y, external force that removes the lubricant accumulated on the fixed blade 53Y acts.

In this case, the rotary member 500 has two or more rotation patterns in which one or both of the rotational direction and the rotation speed is/are made different by the rotational direction or the rotation speed being controlled by the controller 100. For example, when a different rotational direction (normal direction/forward direction) is imparted to the rotary member 500, a displacement angle and a displacement position of the fixed blade 53Y become different in accordance with the rotational direction. Similarly, when a different rotation speed is imparted to the rotary member 500, a displacement speed and a displacement period of the fixed blade 53Y become different in accordance with the rotation speed. Thus, switching between displacement modes for the fixed blade 53Y can be performed by performing switching between the rotation patterns.

For example, in a case where there are two rotation patterns, the switching between the rotation pattern is performed by performing alternate switching between the two rotation patterns. Additionally, when there are three or more rotation patterns, the switching between the rotation patterns may be performed by performing switching between the three or more rotation patterns in turn, or by performing random switching between the three or more rotation patterns in a form that rotation patterns are different from each other before and after the switching. Note that the above-described pattern switching method is similar in second to fin embodiments described later.

Note that the rotary member 500 is stopped at a predetermined rotation angle prior to termination of a lubricant removal mode, and is controlled so as to become the non-abutting state during image forming operation.

Second Embodiment

Figure 4A:
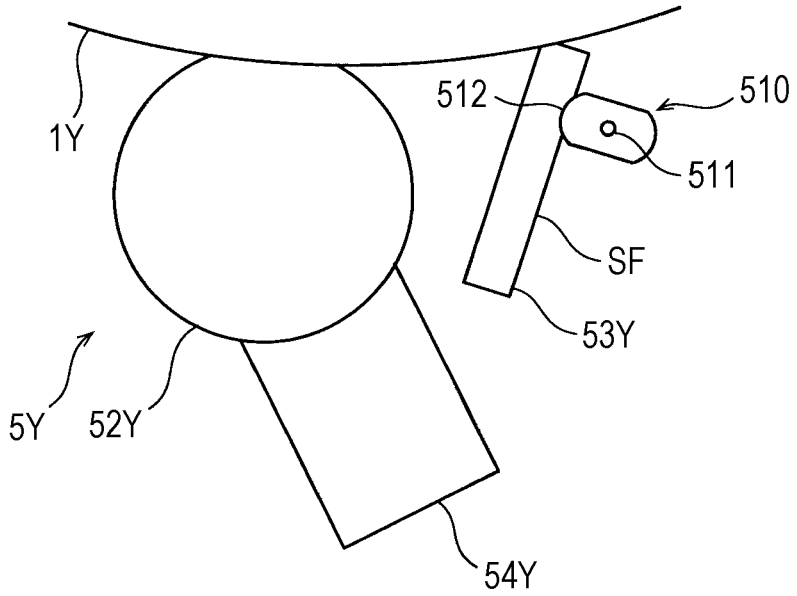
FIGS. 4A and 4B are explanatory diagrams illustrating main components of a cleaning device according to a second embodiment.
Figure 4B:
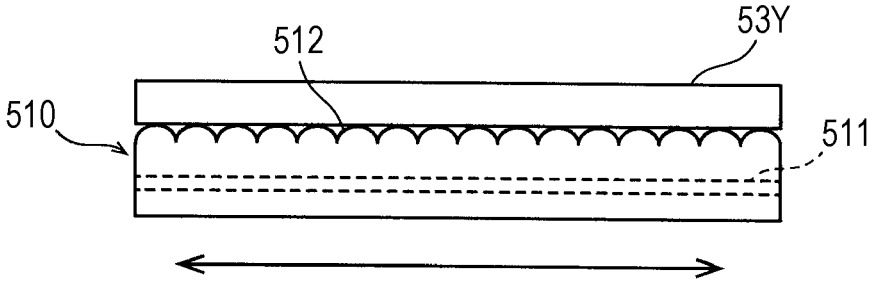

FIGS. 4A and 4B are explanatory diagrams illustrating main components of a cleaning device 5Y according to a second embodiment. In FIGS. 4A and 4B, FIG. 4A illustrates a cleaning device 5Y from a side surface side of a photoreceptor drum 1Y, and FIG. 4B illustrates a fixed blade 53Y and a swing member 510 from a front side of the photoreceptor drum 1Y. In the second embodiment, the cleaning device 5Y includes the swing member 510. The swing member 510 is arranged in the vicinity of the fixed blade 53Y on a non-abutting surface SF side that is included in the fixed blade 53Y and does not abut on the photoreceptor drum 1Y.

A rotary shaft 511 extending along an axial direction of the photoreceptor drum 1Y is attached to the swing member 510, and the swing member 510 is rotated together with the rotary shall 511. A power transmission mechanism such as a motor or a gear is connected to the rotary shaft 511, and a rotation angle is controlled by a controller 100.

Additionally, the swing member 510 is swingable along the axial direction of the photoreceptor drum 1Y. A power transmission mechanism such as a motor or a gear is connected to the swing member 510, and a swing speed and a swing distance are controlled by the controller 100.

In the swing member 510, a cross-sectional shape of a two-dimensional plane which the rotary shaft 511 perpendicularly passes through is formed in an ellipse or an oval. The swing member 510 can perform, by own rotation, switching between an abutting state and a non-abutting state relative to the fixed blade 53Y. The swing member 510 is provided as an abutting part 512 having one end in a longitudinal direction abut on the non-abutting surface SF of the fixed blade 53Y, and this abutting part 512 is formed in a shape having recesses and projections.

When the rotary shaft 511 is rotated, the swing member 510 is also rotated synchronously. When the swing member 510 is rotated, the abutting part 512 of the swing member 510 abuts on the fixed blade 53Y. Furthermore, when the swing member 510 swings in this state, the abutting part 512 of the swing member 510 slides on the non-abutting surface SF of the fixed blade 53Y.

Since the abutting part 512 having the recesses and the projections slide on the non-abutting surface SF of the fixed blade 53Y, external force acts on the non-abutting surface SF of the fixed blade 53Y, thereby displacing the fixed blade 53Y. Due to such displacement of the fixed blade 53Y, external force that removes the lubricant accumulated on the fixed blade 53Y acts.

In this case, the swing member 510 has two or more swing patterns in which one or both of the swing speed and the swing distance is/are made different by the swing speed and the swing distance being controlled by the controller 100. For example, when a different swing speed is imparted to the swing member 510, a displacement speed and a displacement period of the fixed blade 53Y become different in accordance with the swing speed. Similarly, when a different swing distance is imparted to the rotary member 500, a displacement amount and the displacement period of the fixed blade 53Y become different in accordance with the swing distance. Thus, switching between displacement modes for the fixed blade 53Y can be performed by performing switching between the swing patterns.

Note that the swing member 510 is stopped at a predetermined rotation angle prior to termination of a lubricant removal mode, and is controlled so as to become the non-abutting state during image forming operation.

Third Embodiment

Figure 5:
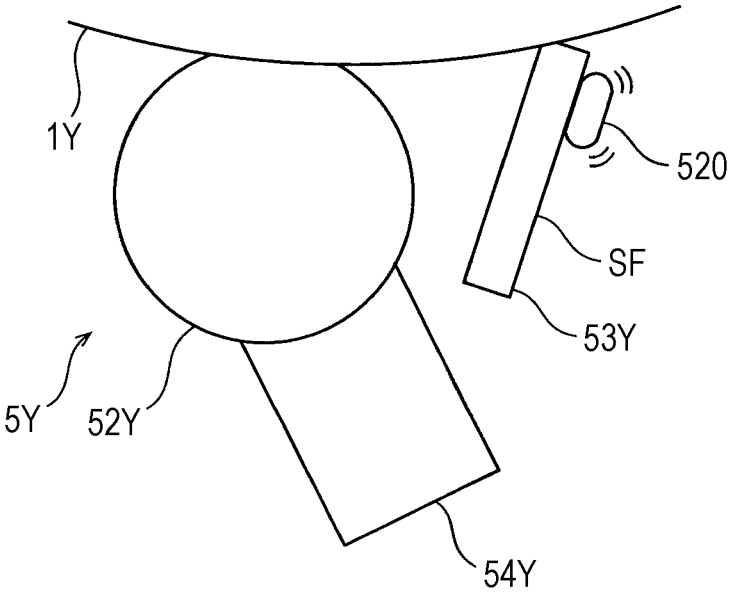
FIG. 5 is an explanatory diagram illustrating main components of a cleaning device according to a third embodiment.

FIG. 5 is an explanatory diagram illustrating main components of a cleaning device 5Y according to a third embodiment. In the third embodiment, the cleaning device 5Y includes a vibration applicator 520. The vibration applicator 520 is arranged in the vicinity of a fixed blade 53Y on a non-abutting surface SF side that is included in the fixed blade 53Y and does not abut on a photoreceptor drum 1Y. The vibration applicator 520 includes a vibrator or the like that generates vibration, and applies vibration to the fixed blade 53Y.

When the vibration applicator 520 is operated, external force acts on the non-abutting surface SF of the fixed blade 53Y by the vibration applied from the vibration applicator 520, thereby displacing the fixed blade 53Y Due to such displacement of the fixed blade 53Y, external force that removes the lubricant accumulated on the fixed blade 53Y acts.

In this case, the vibration applicator 520 has two or more vibration patterns in which one or both of vibration intensity and a vibration frequency is/are made different by the vibration intensity and the vibration frequency being controlled by a controller 100. For example, when different vibration intensity is imparted to the vibration applicator 520, a displacement amount, a displacement angle, and a displacement position of the fixed blade 53Y become different in accordance with the vibration intensity. Similarly, when a different vibration frequency is imparted to the vibration applicator 520, a displacement period of the fixed blade 53Y becomes different in accordance with the vibration frequency. Thus, switching between displacement modes for the fixed blade 53Y can be performed by performing switching between the vibration patterns.

Note that, in this embodiment, the single vibration applicator 520 is provided and performs the switching between the vibration patterns (vibration intensity and vibration frequency) of the vibration applicator 520. However, it may be also possible to adopt a method in which a plurality of vibration applicators 520 set to have different vibration patterns is provided and switches a vibration applicator 520 to be operated.

Fourth Embodiment

Figure 6:
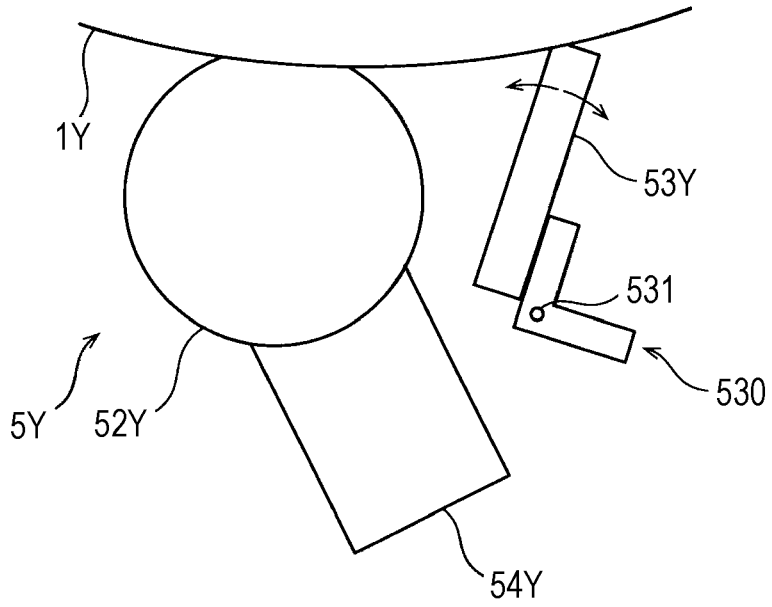
FIG. 6 is an explanatory diagram illustrating main components of a cleaning device according to a fourth embodiment.

FIG. 6 is an explanatory diagram illustrating main components of a cleaning device 5Y according to a fourth embodiment. In the fourth embodiment, a fixed blade 53Y of the cleaning device 5Y includes a rotation mechanism 530 connected to a base end side of the fixed blade 53Y.

A rotary shaft 531 extending along an axial direction of a photoreceptor drum 1Y is attached to the rotation mechanism 530, and the rotation mechanism 530 is rotated around the rotary shaft 531. A rotation speed or a rotation angle of the rotation mechanism 530 is controlled by a controller 100.

When the rotation mechanism 530 is rotated, the fixed blade 53Y is also rotated synchronously. Since the rotation mechanism 530 is repeatedly rotated in a normal direction and an inverse direction by a predetermined rotation angle, the fixed blade 53Y is also rotated together with the rotation mechanism 530, and the fixed blade 53Y repeats abutting (contacting) on and, separating from the photoreceptor drum 1Y.

At this time, the fixed blade 53Y largely bites into the photoreceptor drum 1Y in accordance with abutting force of the fixed blade 53Y on the photoreceptor drum 1Y, As a result, the fixed blade 53Y is displaced. Due to such displacement of the fixed blade 53Y, external force that removes the lubricant accumulated on the fixed blade 53Y acts.

In this case, the rotation mechanism 530 has two or more rotation patterns in which one or both of a rotation speed and a rotation angle is/are made different by the rotation speed and the rotation angle being controlled by the controller 100. For example, when a different rotation speed is imparted to the rotary member 500, a displacement speed and a displacement period of the fixed blade 53Y become different in accordance with the rotation speed. Similarly, when a different rotation angle is imparted to the rotary member 500, a displacement amount and the displacement period of the fixed blade 53Y become different in accordance with the rotation angle. Thus, switching between displacement modes for the fixed blade 53Y can be performed by performing switching between the rotation patients.

Fifth Embodiment

Figure 7:
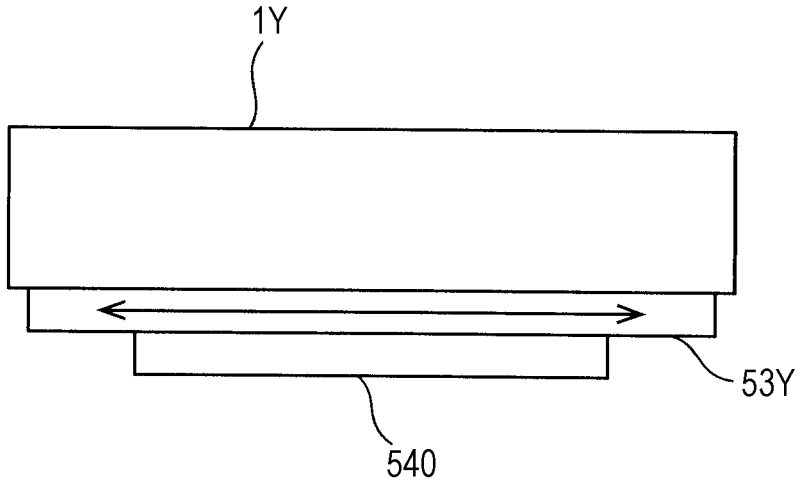
FIG. 7 is an explanatory diagram illustrating main components of a cleaning device according to a fifth embodiment.

FIG. 7 is an explanatory diagram illustrating main components of a cleaning device 5Y according to a fifth embodiment. In the fifth embodiment, a fixed blade 53Y of the cleaning device 5Y can swing along an axial direction of a photoreceptor drum 1Y. The fixed blade 53Y includes a swing mechanism 540 including a motor, a gear, or the like, and a swing speed and a swing distance is controlled by a controller 100.

When the swing mechanism 540 is operated, the fixed blade 53Y slides on the photoreceptor drum 1Y. Consequently, external force acts on the fixed blade 53Y, and the fixed blade 53Y is displaced. Due to such displacement of the fixed blade 53Y, external force that removes the lubricant accumulated on the fixed blade 53Y acts.

In this case, the fixed blade 53Y has two or more swing patients in which one or both of the swing speed and the swine distance is/are made different by the swing speed and the swing distance being controlled by the controller 100. For example, when a different swing speed is imparted to the fixed blade 53Y, a displacement speed and a displacement period of the fixed blade 53Y become different in accordance with the swing speed, when a different swing distance is imparted to the fixed blade 53Y, a displacement amount and the displacement period of the fixed blade 53Y become different in accordance with the swing distance. Thus, switching between displacement modes for the fixed blade 53Y can be performed by performing switching between the swing patterns.

The methods described in the respective embodiments can be utilized independently or in an arbitrary combination of the methods.

For example, the number of prints in the image forming apparatus may be used to determine start of the lubricant removal mode. However, since generation frequency of color streaks is affected by an environment and a lubricant consumption amount, it is preferable to dynamically control the number of sheets to start the lubricant removal mode while using the environment and the lubricant consumption amount as conditions. Specific examples will be described below.

First, a description will be provided for a method in which the number of sheets to start the lubricant removal mode is controlled by the environment. In a low-temperature environment; the application brush 52Y becomes hard, and therefore, frictional force is increased, and the lubricant consumption amount is increased. Therefore, a lubricant amount supplied to the fixed blade 53Y is increased. Additionally, hardness of the lubricant is increased, and this brings a disadvantage to film formation by the fixed blade 53Y and the lubricant amount accumulated on the fixed blade 53Y is increased. As a result, image noise caused by sneak-through of the granular lubricant tends to occur. Considering this, the lower temperature the environment has, the smaller number of sheets the controller 100 sets for the number of sheets to start the lubricant removal mode.

On the other hand, in a high-humidity environment, a toner charge amount is decreased. Therefore, inclination of a development characteristic (characteristic indicating a relation between applied voltage and development efficiency) becomes large. In this case, the surface potential of the photoreceptor drum 1Y fluctuates due to the granular lubricant that has sneaked, but fluctuation of an image density relative to the potential fluctuation is increased in the high-humidity environment. As a result, image noise caused by sneak-through of the granular lubricant tends to occur. Therefore, the higher timidity the environment has, the smaller number the controller 100 sets for the number of sheets to start the lubricant removal mode.

Next, a description will be provided for a method in which the number of sheets to start the lubricant removal mode is controlled by the lubricant consumption amount In a case where the lubricant consumption amount is increased by some control, specifically, in a case where a speed ratio θ of the application brush 52Y to the photoreceptor drum 1Y is increased, the number of sheets to start the lubricant removal modes is set to the small number. Accordingly, the more increased the lubricant consumption amount per unit time is, the smaller number the controller 100 sets for the number of sheets to the start the lubricant removal mode.

Additionally, in a case where the lubricant is pressed against the application brush 52Y by the compression spring, a height of the lubricant is decreased as the lubricant is consumed. For this reason, a use length of time compression spring becomes long, pressing force is decreased, and the consumption amount of the lubricant is reduced. Accordingly, the controller 100 sets the number of sheets to start the lubricant removal mode to the larger number as the lubricant is consumed.

Figure 8:
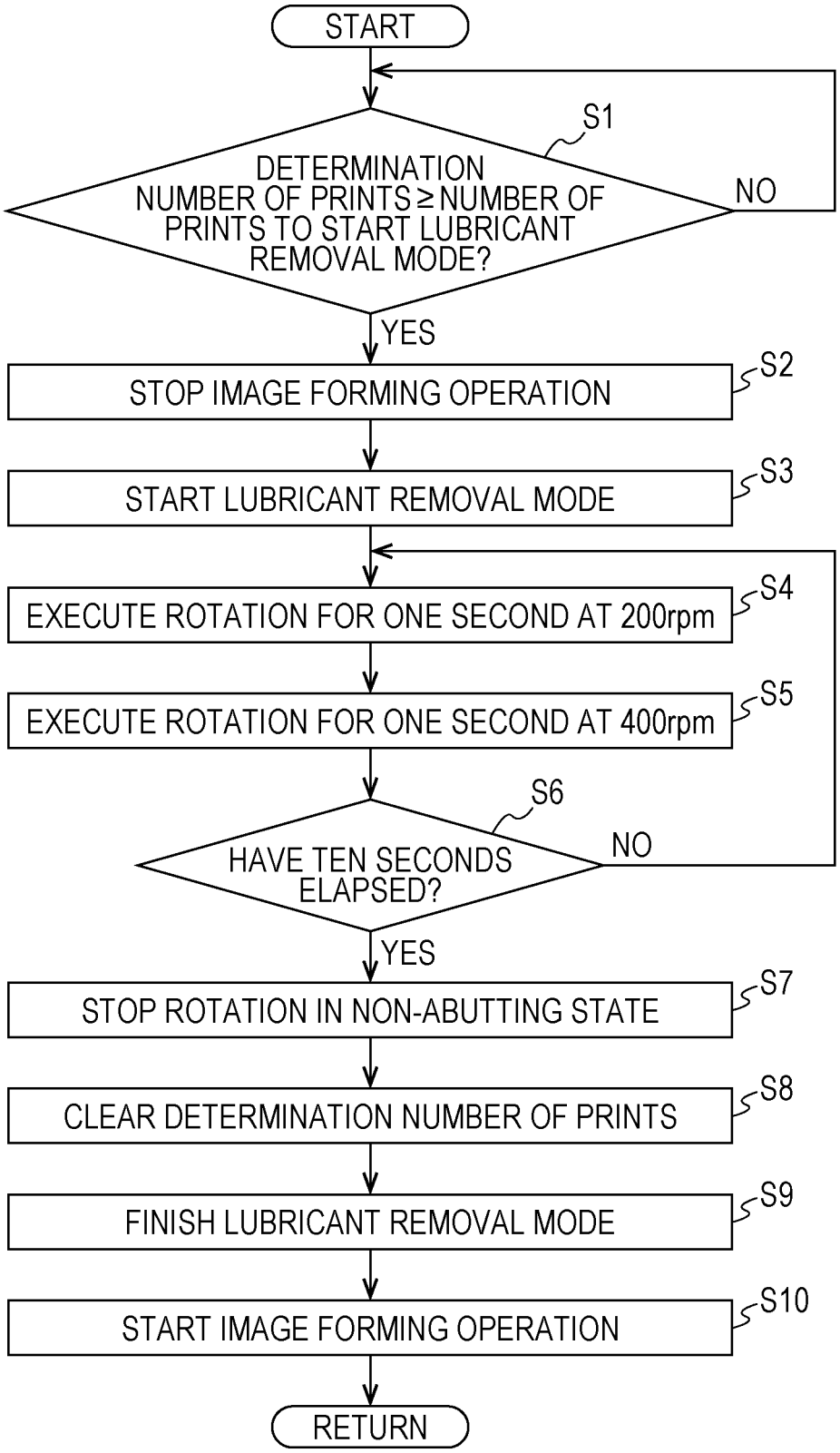
FIG. 8 is a flowchart illustrating operation of the image forming apparatus.

FIG. 8 is a flowchart illustrating operation of the image forming apparatus. This flowchart is processing to execute the lubricant removal mode and is executed by the controller 100, in the following description of the operation, it is a premise that the structure of the above-described first embodiment is provided, and it is assumed that two rotation patterns respectively having different rotation speeds (200 rpm and 400 rpm) are provided.

First, in step S1, the controller 100 determines whether the determination number of prints to determine switching to the lubricant removal mode has reached the number of sheets to start the lubricant removal mode. In a case where the determination number of prints has reached the number of sheets to start the lubricant removal mode, an affirmative determination is made in step S1, and the processing proceeds to step S2. On the other hands, in a case where the determination number of prints has not yet reached the number of sheets to start the lubricant removal mode, a negative determination is made in step S1, and the processing returns to step S1.

In step S2, the controller 100 stops the image forming operation.

In step S3, the controller 100 starts the lubricant removal mode.

In step S4, the controller 100 rotates the rotary member 500 at 200 mm for one second.

In step S5, the controller 100 rotates the rotary member 500 at 400 rpm for one second.

In step S6, the controller 100 determines whether predetermined mode duration (for example, ten seconds) has elapsed from the start of the lubricant removal mode. In a case where the lubricant removal mode is continued over the mode duration, an affirmative determination is made in step S6, and the processing proceeds to step S7. On the other hand, in a case where the lubricant removal mode is not continued over the mode duration, a negative determination is made in step S6, and the processing returns to step S4.

In step S7, the controller 100 stops the rotary member 500 in the non-abutting state.

In step S8, the controller 100 clears the determination number of prints.

In step S9, the controller 100 finishes the lubricant removal mode.

In step S10, the controller 100 staffs the image forming operation.

In the following, evaluation results obtained by evaluating lubricant removal performance with regard to each of the above-described first to fifth embodiments will be described below together with Comparative Examples 1 to 6.

(1) System Configuration

Details of a system configuration in each of the first to fifth embodiments and Comparative Examples 1 to 6 are as follows.

Process speed: 400 mm/s
Cleaning blade
Material: polyurethane
Rubber hardness: 70
Abutting force: 30 N/m
Abutting angle: 20°
Lubricant application brush
Material: acrylic
Fineness: 3 d
Density: 150 KF/inch
Outer diameter: 14 mm
Bite amount into photoreceptor drum: 1 mm
Speed ratio θ: 0.5
Lubricant
Material: ZnSt
Pressing force: 5 N
Fixed blade
Material: polyurethane
Rubber hardness: 70
Bite amount into photoreceptor drum: 0.5 mm
Abutting angle: 50°
Thickness: 1.5 mm
First embodiment: rotary member 500 (FIG. 3 and FIG. 9)
Cross-sectional shape: oval cam
Material: SUS
Bite amount during abutment: 0.8 mm
Second embodiment: swing member 510 (FIGS. 4A, 4B, and 10)
Cross-sectional shape: similar to the first embodiment
Material: SUS
Bite amount during abutment: 0.8 mm
Third embodiment: vibration applicator 520 (FIG. 5)
Piezoelectric element-type oscillator
Fourth embodiment: rotation mechanism 530 (FIG. 6)
Rotatable in a direction in which the biting amount of the fixed blade into the photoreceptor drum is increased more than 0.5 mm described above
Fifth embodiment: swing mechanism 540 (FIG. 7)
Swingable in an axial direction of the photoreceptor drum while keeping the biting amount of the fixed blade into the photoreceptor drum at 0.5 mm described above (2) Environment Temperature 30° C. and Humidity 80%

(3) Evaluation Method

A vertical band chart with an average coverage of 10% was printed on 10,000 sheets of an A4 horizontal format, one hundred sheets are extracted per thousand sheets, and a generation rate of the image noise (color streaks) (number of sheets having image noise/number of evaluated sheets) was calculated. The generation rate of 3% or less is determined (evaluated) as good.

(4) Detailed Content in Evaluation

Comparative Example 1

No lubricant removal mode was provided.

Comparative Example 2

The lubricant removal mode was executed for ten seconds per two thousand sheets.
Structure: similar to the first embodiment
Rotation pattern (one kind): rotation speed 400 rpm First Embodiment The lubricant removal mode was executed for ten seconds per two thousand sheets.
Rotation pattern (two kinds): rotation speeds 200 rpm and 400 rpm (switched every second)

Comparative Example 3

The lubricant removal mode was executed for ten seconds per two thousand sheets.
Structure: similar to the second embodiment
Swing pattern (one kind): swing distance 5 mm and swing speed 100 mm/s Second Embodiment The lubricant removal mode was executed for ten seconds per two thousand sheets.
Swing pattern (two kinds): swing distance 2.5 mm and 5 mm (switched every second) and swing speed 100 mm/s in each of the swing patterns Comparative Example 4

The lubricant removal mode was executed for ten seconds per two thousand sheets.
Structure: similar to the third embodiment
Vibration pattern (one kind): vibration frequency 50 KHz Third Embodiment The lubricant removal mode was executed for ten seconds per two thousand sheets.

Vibration pattern (two kinds): vibration frequency 30 KHz and 50 KHz (switched every second)

Comparative Example 5

The lubricant removal mode was executed for ten seconds per two thousand sheets.

Structure: similar to the fourth embodiment

Rotation pattern (one kind): the biting amount into the photoreceptor drum is periodically changed between an initial state (0.5 mm) and 1.5 mm Fourth Embodiment The lubricant removal mode was executed for ten seconds per two thousand sheets.

Vibration pattern (two kinds): the biting amount into the photoreceptor drum is periodically changed between the initial state (0.5 mm) and 1 mm and between the initial state and 1.5 mm Comparative Example 6

The lubricant removal mode was executed for ten seconds per two thousand sheets.

Structure: similar to the fifth embodiment

Wing pattern (one kind): swing distance 2 mm and swing speed 100 mm/s

Fifth Embodiment

The lubricant removal mode was executed for ten seconds per two thousand sheets.

Swing pattern (two kinds): swing distance 1 mm and 2 mm (switched every second), and swing speed 100 mm/s in each of the swing patterns FIG. 11 is an explanatory diagram illustrating an image noise generation rate in the first to fifth embodiments and Comparative Examples 1 to 6. All of the methods illustrated in the first to fifth embodiments exhibited the image noise generation rate lower than those in the methods illustrated in Comparative Examples 1 to 6. Additionally, in all of the first to fifth embodiments, the image noise generation rate was 3% or less and good results were obtained.

Thus, in the image forming apparatus according to the present embodiments, the controller 100 has the lubricant removal mode to remove the lubricant accumulated on the fixed blade 53Y. The lubricant removal mode has a plurality of displacement modes in each of which different displacement is imparted to the fixed blade 53Y In this case, in each of the displacement modes, any one of the displacement amount, the displacement speed, the displacement period, the displacement angle, and the displacement position of the blade is different. Additionally, the controller 100 performs the switching between the displacement modes during execution of the lubricant removal mode.

Since the lubricant has the high cohesion and the high adhesion unlike the toner, it is more difficult to remove the lubricant than the toner. In the lubricant having the high cohesion, the lubricant cannot be removed well only by applying the external force with a single pattern due to synchronization with the displacement of the fixed blade 53Y. Therefore, to efficiently remove the lubricant having the high cohesion, it is necessary to apply various types of external force and impart the plurality of displacement modes in a combined manner.

Additionally, the rubber material is used for the fixed blade 53Y. Therefore, the respective kinds of displacement act in combination by performing the switching between the displacement modes during the lubricant removal mode, and various kinds of displacement can be imparted to the fixed blade 53Y. Since the rubber material is an elastic body, balance between compression and tension is changed even in a case of changing, for example, a speed imparted to the fixed blade 53Y. As a result, the direction and the position of displacement can be changed.

Thus, to efficiently remove the lubricant accumulated on the fixed blade 53Y, it is effective to displace the fixed blade 53Y in various forms. Consequently, even the lubricant which can be hardly removed by a single displacement mode can be effectively removed by performing the switching between the different displacement modes and imparting the plurality kinds of displacement.

Parameters of each displacement mode include the displacement amount, the displacement speed, the displacement period, the displacement angle, the displacement position, and the like of the fixed blade 53Y.

Furthermore, a function of the cleaning blade 51Y is mainly to prevent the toner from sneaking. On the other hand, a function of the fixed blade 53Y is to form a film of the lubricant while allowing the lubricant to sneak. Therefore, the cleaning performance of the fixed blade 53Y is needed to be set lower than that of the cleaning blade 51Y. Accordingly, it is more advantageous to have a wide nip width for the cleaning blade 51Y in order to accelerate the film formation. Additionally, since the toner as a lubricant agent is not basically received in the fixed blade 53Y, there is a high risk to cause initial turning-up of the blade. Therefore, it is effective that the fixed blade 53Y is made to abut in the trail direction.

Accordingly, in the present embodiments, the fixed blade 53Y is displaced by making the fixed blade 53Y abut in the trail direction and applying the external force from the non-abutting surface SF.

The image forming apparatus according to the embodiments of the present invention has been described above, but needless to mention that the present invention is not limited to the above-described embodiments, and various modifications can be made within the scope of the invention. For example, according to the present embodiments, the photoreceptor chum is exemplified as the image carrier, but a transfer belt may also be used.

Additionally, in the present embodiment, the displacement modes and various patterns to implement these displacement modes have been described. However, the above-described patterns are examples, and it is possible to widely apply a method of displacing the displacement amount, the displacement speed, the displacement period, the displacement angle, and the displacement position of the blade.

Although embodiments of the present invention have been described and illustrated in detail, the disclosed embodiments are tirade for purposes of illustration and example only and not limitation. The scope of the present invention should be interpreted by terms of the appended claims.

What is claimed is:

1. An image forming apparatus comprising:

an image carrier rotatably supported;

a lubricant supplier that supplies lubricant to a surface of the image carrier;

a blade that levels the lubricant supplied front the lubricant supplier in a film-like form on the surface of the image carrier; and a hardware processor that controls image formation, wherein the hardware processor has a lubricant removal mode to remove the lubricant accumulated on the blade, the lubricant removal mode includes a plurality of displacement modes each of which imparts different displacement to the blade, in each of the displacement modes, one of a displacement amount, a displacement speed, a displacement period, a displacement angle, and a displacement position of the blade is different, and the hardware processor performs switching between the displacement modes during execution of the lubricant removal mode.

2. The image forming apparatus according to claim 1, further comprising a cam-shaped rotary member that is rotatably arranged in vicinity of the blade, and can perform, by own rotation, switching between an abutting state and a non-abutting state relative to the blade, wherein the rotary member has two or more rotation patterns in which one or both of a rotational direction and rotation speed is/are different, and switching between the displacement modes is performed by performing switching between the rotation patterns.

3. The image forming apparatus according to claim 2, wherein the rotary member is arranged on a non-abutting surface side that is included in the blade and does not abut on the image carrier.

4. The image forming apparatus according to claim 1, further comprising a swing member that is rotatably arranged in the vicinity of the blade, can perform, by own rotation, switching between an abutting state and a non-abutting state on the blade, and is provided with recesses and projection on a surface that abuts on the blade, wherein the swing member is swingable along an axial direction of the image carrier, and has two or more swing patterns in which one or both of a swing speed and a swing distance is/are different, and switching between the displacement modes is performed by performing switching between the swing patterns.

5. The image forming apparatus according to claim 4, wherein the swing member is arranged on a non-abutting surface side that is included in the blade and does not abut on the image carrier.

6. The image forming apparatus according to claim 1, further comprising a vibration applicator that imparts vibration to the blade, wherein the vibration applicator has two or more vibration patterns in which one or both of vibration intensity and a vibration frequency is/are different, and switching between the displacement modes is performed by performing switching between the vibration patterns.

7. The image forming apparatus according to claim 6, wherein the vibration applicator is arranged on a non-abutting surface side that is included in the blade and does not abut on the image carrier.

8. The image forming apparatus according to claim 1, wherein the blade includes a rotation mechanism that repeats contacting and separating, from the image carrier by repeating rotation in a normal direction and an inverse direction, and has two or more rotation patterns in which one or both of a rotation speed and a rotation angle is/are different, and switching between the displacement modes is performed by performing switching between the rotation patterns.

9. The image forming apparatus according to claim 1, wherein the blade includes a swing mechanism that swings along an axial direction of the image carrier, and has two or more swing patterns in which one or both of a swing speed and a swing distance is/are different, and switching between the displacement modes is performed by perforating switching between the swing patterns.

10. The image forming apparatus according to claim 1, wherein the blade is arranged in a manner being pressed against the image carrier in a state where a tip of the blade is oriented in a direction same as a rotational direction of the image carrier.

* * * * *